US006289857B1

(12) United States Patent
Boggs

(10) Patent No.: US 6,289,857 B1
(45) Date of Patent: Sep. 18, 2001

(54) VARIABLE CAPACITY RECIPROCATING ENGINE

(75) Inventor: David L. Boggs, Bloomfield Hills, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/511,044

(22) Filed: Feb. 23, 2000

(51) Int. Cl.[7] ..... F02B 75/04
(52) U.S. Cl. ..... 123/78 E; 123/48 B
(58) Field of Search ..... 123/78 F, 78 E, 123/48 B

(56) References Cited

U.S. PATENT DOCUMENTS

| | | | | |
|---|---|---|---|---|
| 4,112,826 | | 9/1978 | Cataldo . | |
| 4,131,094 | | 12/1978 | Crise . | |
| 4,319,498 | | 3/1982 | McWhorter . | |
| 4,437,438 | | 3/1984 | Mederer . | |
| 4,485,768 | | 12/1984 | Heniges . | |
| 4,538,557 | * | 9/1985 | Kleiner et al. | 123/78 E |
| 4,738,230 | * | 4/1988 | Johnson | 123/56 BC |
| 5,136,987 | * | 8/1992 | Schechter et al. | 123/48 B |
| 5,163,386 | * | 11/1992 | Schechter | 123/48 B |
| 5,178,038 | * | 1/1993 | Heniges | 74/591 |
| 5,406,911 | * | 4/1995 | Hefley | 123/48 B |
| 5,762,480 | | 6/1998 | Adahan . | |
| 5,908,014 | * | 6/1999 | Leithinger | 123/78 F |
| 6,167,851 | * | 1/2001 | Bowling | 123/48 B |

OTHER PUBLICATIONS

"A Variable–Radius/Length Engine", by Kenichi Kajiwara, SAE Technical Paper No. 920453, pp. 1–8.

"The Otto–Atkinson Cycle Engine–Fuel Economy And Emissions Results And Hardware Design", by D.L. Boggs et al, SAE Technical Paper No. 950089, Feb. 27–Mar. 2, 1995, pp. 1–13.

* cited by examiner

*Primary Examiner*—Tony M. Argenbright
*Assistant Examiner*—Katrina B. Harris
(74) *Attorney, Agent, or Firm*—Jerome R. Drouillard

(57) ABSTRACT

A reciprocating engine having an engine housing defining a power cylinder, a power piston in the cylinder including a connecting rod extending through the engine housing, a motion transfer mechanism in the engine housing at the end of the connecting rod for translating reciprocating motion of the piston rod to rotary motion of a torque output shaft, and a displacement adjusting mechanism having portions that are common to the motion transmitting mechanism for adjusting the displacement of the engine to effect a variable compression ratio.

5 Claims, 5 Drawing Sheets

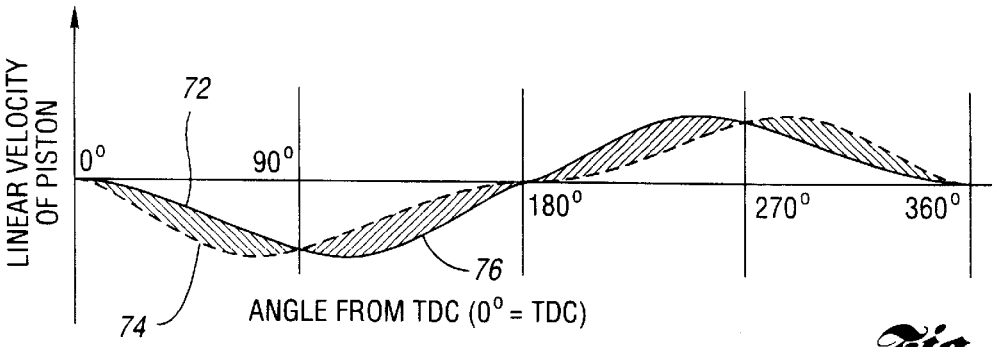
Fig. 4
(PRIOR ART)
Fig. 5
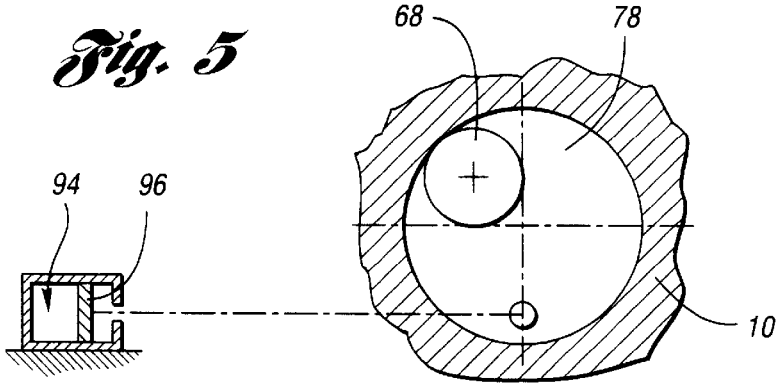
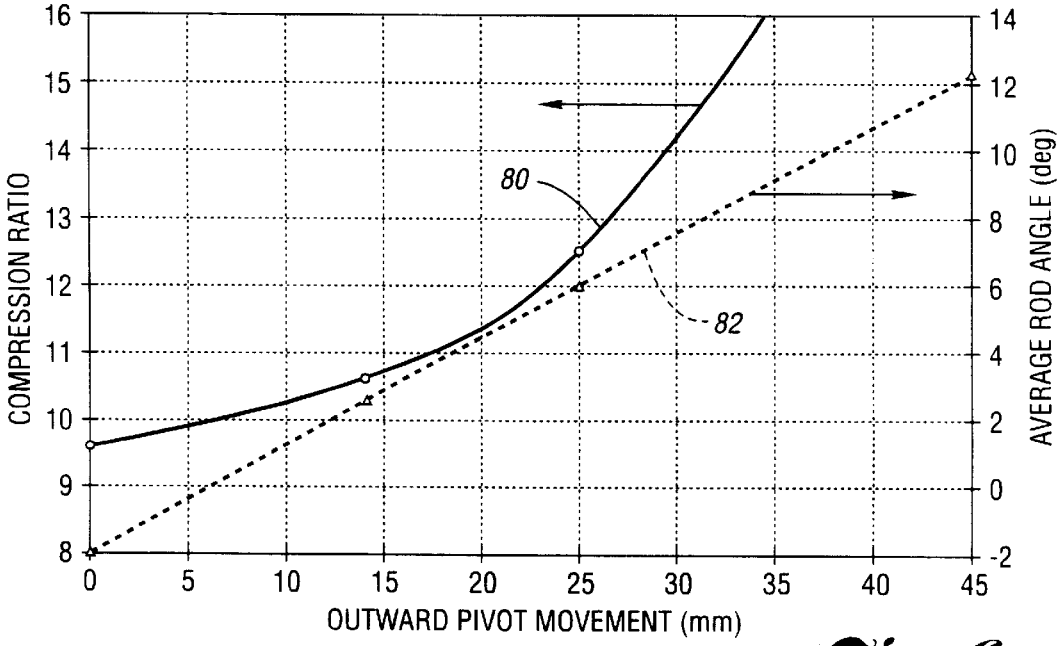
Fig. 6

VARIABLE CAPACITY RECIPROCATING ENGINE

TECHNICAL FIELD

The invention relates to reciprocating engines and a mechanism for converting reciprocating motion of a piston to rotary motion of a torque output shaft.

BACKGROUND ART

The invention comprises an improvement in the reciprocating machine disclosed in U.S. Pat. No. 5,762,480, issued to Carmeli Adahan.

A reciprocating piston engine capable of embodying the improvements of the present invention, like the reciprocating machine of the '480 patent, converts linear reciprocating motion of the piston in the cylinder to rotary motion of a power output shaft wherein the piston is drivably connected to the power output shaft through a connecting rod that moves in a substantially linear fashion. Side loading of the piston is avoided since there are minimal transverse force components associated with the force exerted on the piston by the piston rod. The absence of transverse loading on the piston avoids piston and cylinder wear due to frictional contact between the piston and the surrounding wall of the cylinder.

The reciprocating machine of the '480 patent is characterized also by a reduction in the speed of travel of the piston as the piston reaches its top dead center position. This increases the mechanical efficiency of the reciprocating engine.

In the case of a conventional engine with a crankshaft and a connecting rod between the piston and the crankshaft, it is possible to adjust the compression ratio by changing the effective length of the connecting rod. An example of a hydraulic piston and cylinder mechanism for adjusting the piston rod length is described, for example, in SAE Technical Paper No. 920453, by Kajiwara. The effective connecting rod length can be changed also by a cam and eccentric mechanism, as described in U.S. Pat. No. 4,319,498.

A double connecting rod assembly for a reciprocating piston engine is disclosed in U.S. Pat. No. 4,437,438, which includes a swinging lever that is connected to both elements of a two-piece connecting rod assembly, resulting in higher friction compared to the engine of the '498 patent.

A guide rod in a double connecting rod assembly is disclosed in prior art U.S. Pat. No. 4,131,094, wherein the pivot axis for the guide rod can be changed to alter the effective compression ratio of the reciprocating piston engine.

None of the teachings of these prior art devices is adaptable for use with an engine of the Adahan type to vary compression ratio. Each of the prior art devices for achieving a variable compression ratio increases the effective overall length, weight and friction of the piston and cylinder assembly.

DISCLOSURE OF INVENTION

The variable displacement engine of the invention has a piston and cylinder assembly that define a combustion chamber. A rotary torque output shaft is journalled on a torque output shaft axis that is perpendicular to the piston and cylinder assembly axis.

A crank pin is connected to the torque output shaft. An L-shaped connecting rod has a first portion pivotally connected at one end to the piston. A crank link is pivoted to the crank pin at one of its ends and to the first connecting rod portion at its other end. A second portion of the connecting rod is fixed to the other end of the first connecting rod portion and extends generally transversely relative to the piston and cylinder assembly axis.

An alignment member is pivoted to the transversely extending second connecting rod portion on one side of the piston and cylinder assembly axis and to a pivot member carried by the engine housing at the opposite side of the piston and cylinder assembly axis.

The compression ratio is changed as the distance of the pivot member from the piston and cylinder assembly axis is changed.

It is an objective of the present invention to provide a reciprocating engine of the type disclosed in the '480 patent wherein provision is made for adjusting the displacement of the engine to effect a variable compression ratio. It is possible to vary the compression ratio to achieve improved efficiency with high compression ratio during light load operation and to change the compression ratio so that the engine can operate during high load with a lower compression ratio. The motion transmitting mechanism of the reciprocating engine of the invention will allow for movement of the piston, as it approaches the top dead center position, to be closer to the cylinder head, thereby reducing the effective volume of the combustion chamber defined by the cylinder, the piston and the cylinder head.

The torque transmitting crank link is connected at one end to a drive pin that is offset with respect to the axis of rotation of the torque output shaft. At the other end, the link is connected to the other end of the first connecting rod portion. The generally transversely disposed end of the second connecting rod portion is connected to the alignment member, the opposite end of the alignment member being pivotally mounted on the transmission housing. Reciprocating motion of the piston is transferred through the connecting rod to the torque transmitting link, which in turn drives the torque output shaft, the axis of the output shaft being located intermediate the ends of the first connecting rod portion. The generally transversely disposed end of the second connecting rod portion, which is connected to the alignment member, has a reciprocating motion as the alignment link pivots about its fixed axis. In this way, the first connecting rod portion travels in a substantially linear fashion, thus avoiding development of side loads on the piston.

Provision is made for adjusting the pivot point for the alignment member toward and away from the axis of rotation of the torque output shaft. The pivotal axis of the alignment member is transversely situated relative to the direction of reciprocating linear motion of the piston.

Movement of the pivot axis for the alignment member effects a change in compression ratio since the end points of the piston travel are changed when the pivot axis is adjusted. Movement of the pivot axis can be accomplished manually or, for example, by means of an electronically controlled motor or a fluid pressure servo.

The geometry of the combustion chamber is not substantially affected by the motion translation mechanism. Conventional combustion chamber geometry may be used.

BRIEF DESCRIPTION OF DRAWINGS

FIG. 4 is a plot showing the linear velocity of the piston versus the angular position of the torque output shaft;

FIG. 5 is a schematic representation of an eccentric mechanism for adjusting the location of the alignment member that forms a part of the motion translating mechanism for converting reciprocating motion of the piston to rotary motion of the torque output shaft;

FIG. 6 is a plot showing the relationship between compression ratio of the engine and the position of the pivot axis for the alignment member.

BEST MODE FOR CARRYING OUT THE INVENTION

Figure 1:
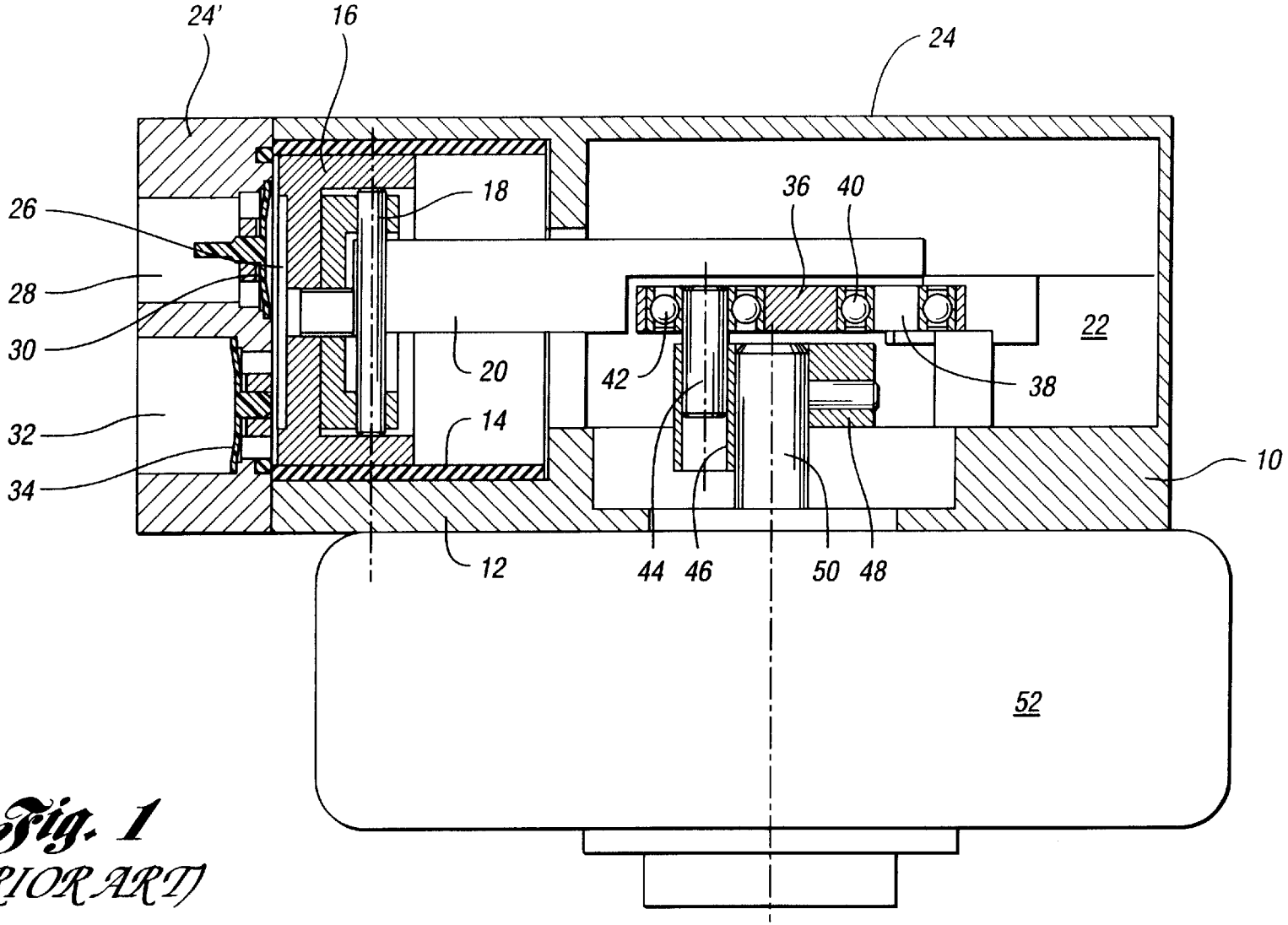
Fig. 1 (PRIOR ART)
FIG. 1 is a cross-sectional view of a reciprocating piston engine, the plane of the section of FIG. 1 containing the centerline of the piston and cylinder assembly.

FIG. 1 shows a reciprocating piston engine of the Adahan type. It comprises an engine housing 10, which includes a cylinder housing 14. A piston 16 received in the cylinder housing 14 is connected by pivot pin 18 to connecting rod 20. The connecting rod extends to an interior cavity 22 in the housing 10.

A valve plate 24' is secured to the end of the cylinder 12. The valve plate 24', the cylinder 14 and the piston 16 define a combustion chamber 26, which communicates with an inlet port 28 through an inlet valve 30. An air/fuel mixture is delivered to the combustion chamber 26 through valve 30. An outlet port 32 communicates with the combustion chamber 26 through an exhaust valve 34, through which combustion gases are discharged to the outlet port 32.

A crank link member 36 is connected to the connecting rod 20 by means of a pivot pin 38 carried at an intermediate connection rod portion between the ends of the connecting rod 20. The pin 38 is journalled in one end of the crank member 36 by bearing 40. The opposite end of the crank member 36 is journalled by bearing 42 on crank pin 44, which is received in opening 46 in flywheel 48. A central opening in the flywheel 48 receives torque output shaft 50, which may drive a generator 52 or a similar implement. Shaft 50 can be connected also to a drive shaft for a wheeled vehicle.

Figure 2:
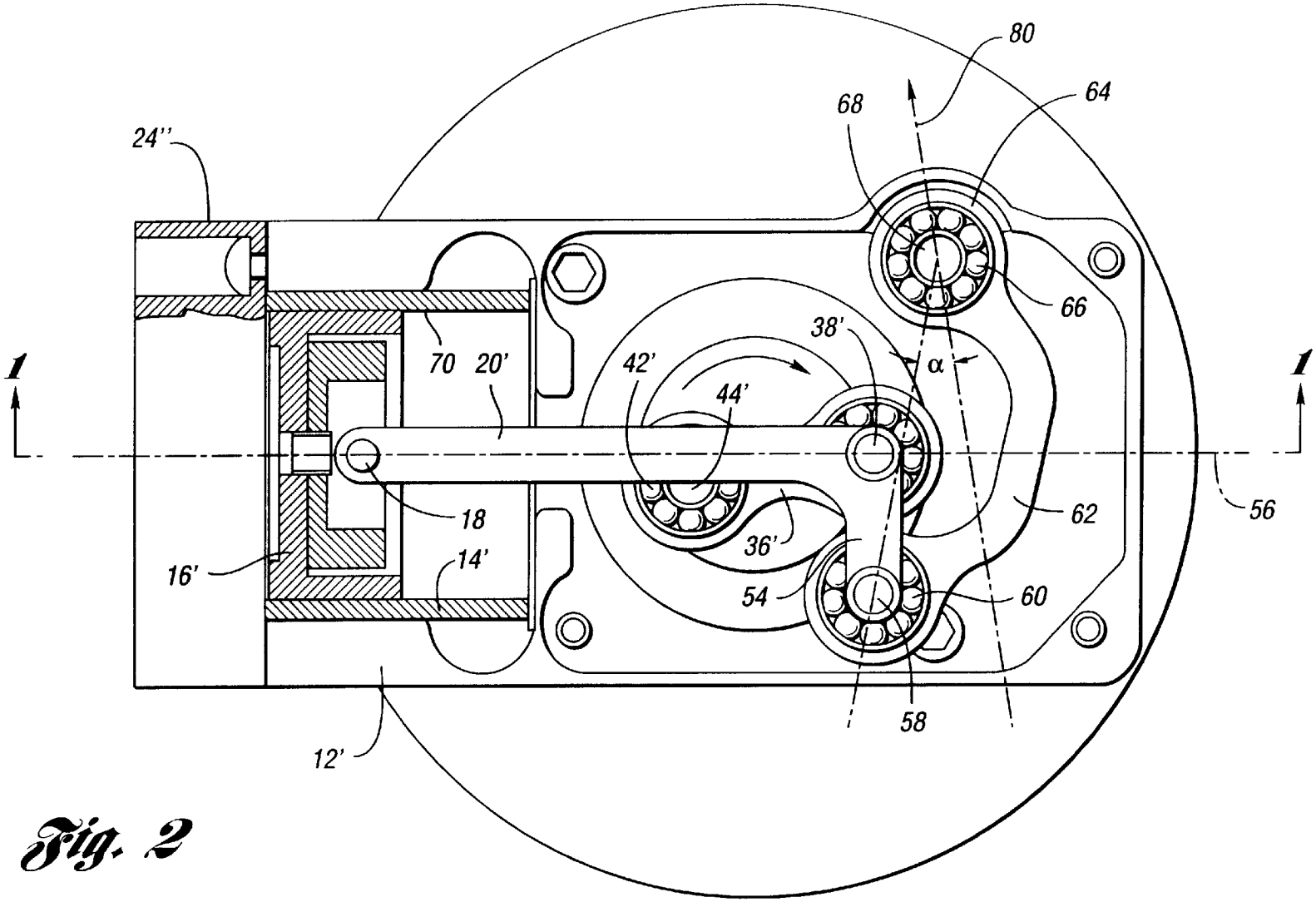
FIG. 2 is a cross-sectional view taken on a plane perpendicular to the plane of FIG. 1.
Figure 3:
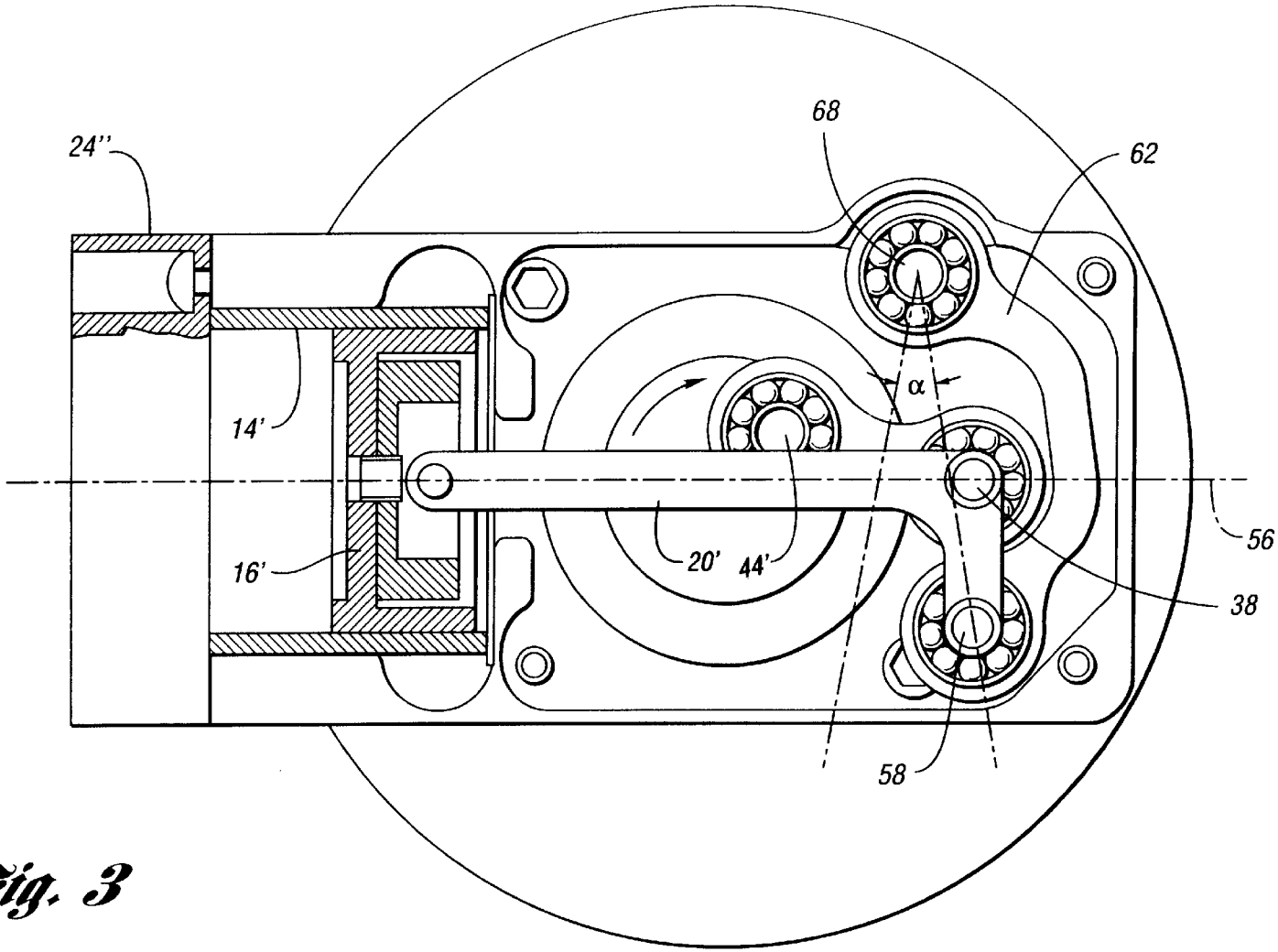
FIG. 3 is a cross-sectional view similar to FIG. 2, although the piston and cylinder assembly are at the bottom dead center position rather than at the top dead center position seen in FIG. 2.

Structural elements of the embodiment of FIGS. 2 and 3 have counterpart elements in the prior art construction of FIG. 1. Those elements in FIGS. 2 and 3 have been designated by the same numerals used in FIG. 1, but prime notations are added.

The embodiment of the invention seen in FIG. 2 has a connecting rod 20' including an end portion 54 or offset arm that extends generally perpendicular to the axis of the cylinder housing 14', which is identified by reference numeral 56. The connecting rod end portion 54 carries a pivot pin 58 that is journalled by bearing 60 to one end of an alignment member 62. The other end of the member 62, shown at 64, is joumalled by bearing 66 on a stationary pin 68, which is secured to the housing 10. The intermediate portion of the alignment member 62 is offset, as shown in FIG. 2, so that it clears the end of the member 36 as the piston is reciprocated in the cylinder 14.

FIG. 2 shows the piston 16' in its top dead center position. At that time, the crank pin 44' is on the lower side of the connecting rod 20', as viewed in FIG. 2, but is relatively close to the axis 56.

When the piston is in its bottom dead center position, shown in FIG. 3, the crank pin is located above connecting rod 20', as viewed in FIG. 3. As the crank link member 36' moves from the position shown in FIG. 2 to the position shown in FIG. 3, the pin 38' and the end of the link member 36', to which it is connected are displaced to the right, as viewed in FIG. 3; but the axis of the pin 38' is generally close to or intersects the axis 56 of the cylinder.

During movement of the piston rod 20' from the top dead center position to the bottom dead center position shown in FIG. 3, the alignment member 62 rotates through an angle a as the connecting rod 20' is displaced in a linear fashion. Combustion gas forces acting on the piston and the reaction forces acting on the connecting rod do not create side loading of the piston against the wall 70 of the cylinder 14'.

FIG. 4 shows a comparison of the linear velocity of the piston to the linear velocity of a conventional piston and crankshaft assembly. The linear velocity of the engine of FIGS. 1, 2 and 3 is shown at 72, and the corresponding linear velocity for a conventional reciprocating piston engine is shown at 74. The top dead center position in FIG. 2 is represented in FIG. 4 by the angular position "0" for the torque output shaft. The linear velocity of the piston is substantially less between the angular positions of zero degrees and 90°. Its acceleration between positions 90° and 180° is greater than the corresponding acceleration for a conventional engine, as indicated at 76. The velocity of travel of the piston in the vicinity of the top dead center position reduces valve wear and effects more efficient valve operation since the valve opening event and the valve closing event can be increased in duration.

In accordance with the teachings of the present invention, the compression ratio of the engine can be changed as the engine load decreases. This is done by moving the location of the pivot pin 68. According to one embodiment of the invention, this is accomplished by an eccentric member 78, as seen in FIG. 5. The member 78, which is circular, carries pin 68 at an offset location. The member 78 is rotatably received in a circular opening in the housing 10. As the member 78 is rotated, the pin 68 will move the end 64 of the alignment member 62 in a direction generally perpendicular to the axis 56.

When the end 64 is moved outwardly, as indicated by the directional arrow 80 seen in FIG. 2, the clearance between the piston 16' and the plate 24' will decrease. This increases the compression ratio for the engine. Movement of the pin 68 in the opposite direction toward the axis 56 will increase the space between the piston 16' and the plate 24" at top dead center. This decreases the compression ratio of the engine.

The relationship of the movement of the pin 68 and the compression ratio is plotted in FIG. 6. As the pin 68 moves outward, the compression ratio increases at a progressively increasing rate, as shown at 80.

As the pin 68 moves outward, the angle of connecting rod 20 will change, as indicated by the plot 82 (FIG. 6). The angular displacement of the rod 20 for a given angular displacement of the member 78 is relatively small for any given angular adjustment of the member 78. Thus, the connecting rod 20 will transmit forces that are generally aligned with the axis 56, thereby avoiding development of undesirable side loads of the piston 16 on the cylinder wall 7.

Figure 7:
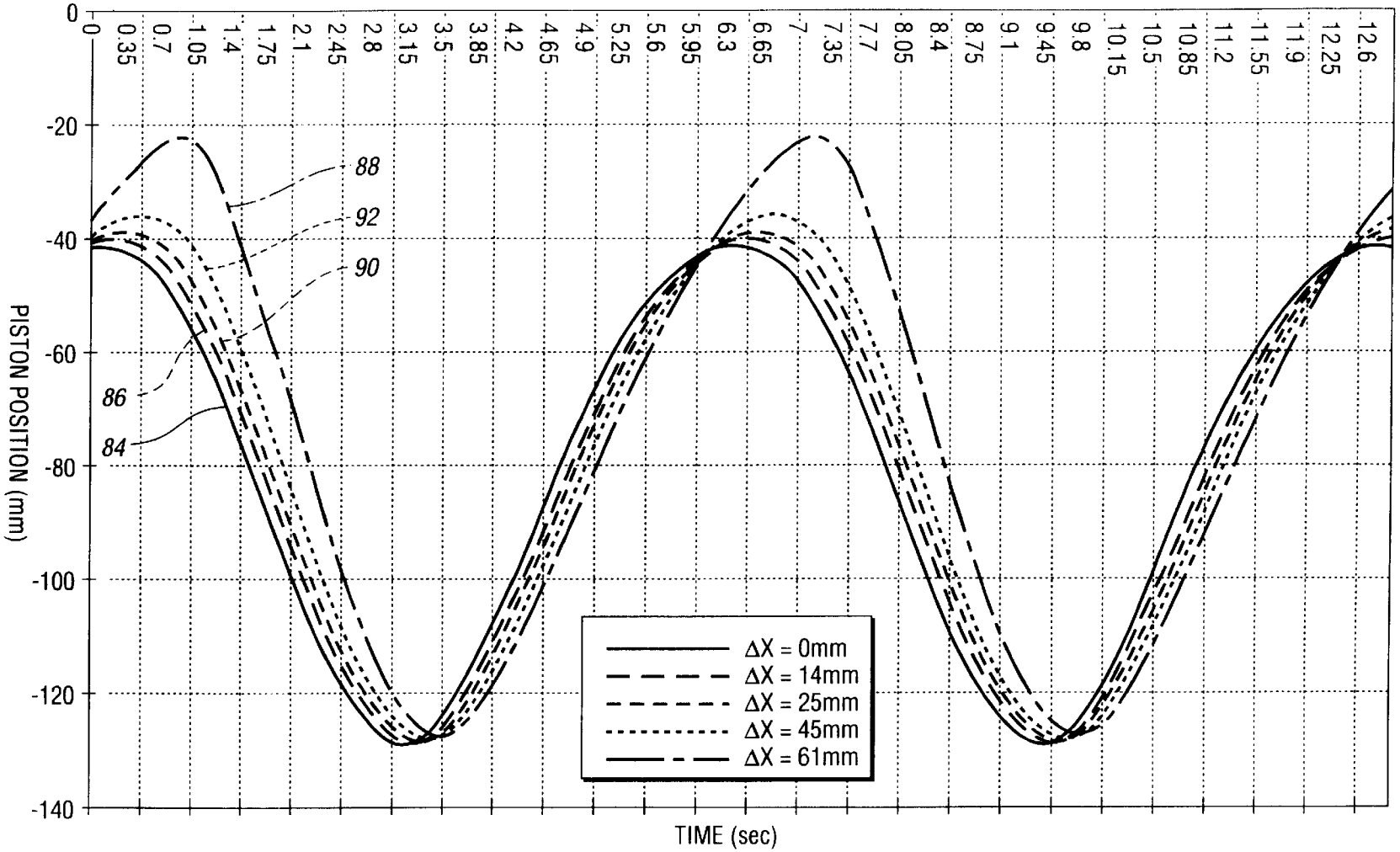
FIG. 7 is a plot that shows the relationship between piston position and piston travel time as the piston reciprocates in the cylinder.

The effect of an adjustment of the member 78 on the position of the piston is plotted in FIG. 7. If the piston is in its top dead center position, and if the adjustment of the pin 68 is zero, the motion trace for the piston is shown at 84. If the member 78 is adjusted so that the pin 68 moves 14 mm, for example, the motion trace for the piston would be represented by the plot 86. If the displacement of pivot pin 68 is a maximum (for example 61 mm), the motion trace for the piston would be indicated at 88. Intermediate plots, corresponding to adjustments of 25 mm and 45 mm for the member 68, also are seen in FIG. 7 at 90 and 92, respectively.

Although the member 78 can be adjusted manually, it is contemplated that automatic adjustments can be made as well, such as by a servo mechanism indicated schematically in FIG. 5 at 94. This mechanism may include a cylinder and a pressure-operated piston 96 connected mechanically to the member 78 so that the member 78 is angularly adjusted as the piston 96 is activated. The piston and cylinder can be secured to the housing 10.

An engine load sensor of conventional design and a conventional electronic engine controller can be used to create a variable pressure for actuating the piston 96 so that the compression ratio can be increased as the load decreases. In a preferred embodiment of the invention, the compression ratio can be changed from 9.6 to 12.5, for example, by moving the pivot pin 68 25 mm in a direction away from the cylinder axis 56. If the engine is operating with a compression ratio of 9.6 under loads that are high, the pivot pin 68 can be adjusted automatically to a higher compression ratio, such as 12.5, to achieve increased engine efficiency when the load decreases.

Although a preferred embodiment of the invention has been described, it will be apparent to persons skilled in the art that modifications may be made without departing from the scope of the invention. All such modifications and equivalents thereof are included within the scope of the following claims.

What is claimed is:

1. An internal combustion reciprocating piston engine comprising a housing with a cylinder with a first axis, a piston in the cylinder, a cylinder head at one end of the cylinder, a combustion chamber defined by the cylinder, the piston and the piston head;

a rotary torque output member journalled in the housing for rotation about a second axis that is perpendicular to the first axis;

a crank pin connected to the torque output member;

a unitary, L-shaped connecting rod having a first portion extending generally in the direction of the first axis and a second portion, integral to the first portion, extending generally transversely relative to the first axis, the first connecting rod portion being pivotally connected at one end thereof to the piston;

a crank link having one end pivotally connected to the crank pin and the other end being pivotally connected to one end of the second connecting rod portion;

an alignment member pivotally connected to the other end of the second connecting rod portion at a location on one side of the first axis and pivotally connected to a pivot member carried by the housing at the opposite side of the first axis; and means for adjusting the distance of the pivot member from the first axis whereby the displacement of the combustion chamber is increased and the compression ratio for the engine is increased when the piston is reciprocated in the cylinder upon rotation of the torque output member.

2. The internal combustion engine set forth in claim 1 wherein the first connecting rod portion extends generally in the direction of the cylinder axis as it reciprocates in the cylinder whereby side loading of the piston on the cylinder is reduced.

3. The internal combustion engine set forth in claim 2 wherein the alignment member comprises a center portion and two end portions, one end portion of the alignment member being pivotally connected to the pivot member and the other end portion of the alignment member being pivotally connected to the transversely extending second connecting rod portion, the center portion being offset in the direction of the first axis thereby providing clearance for the crank link as the crank link rotates with the torque output member.

4. The internal combustion engine set forth in claim 1 wherein the alignment member comprises a center portion and two end portions, one end portion of the alignment member being pivotally connected to the pivot member and the other end portion of the alignment member being pivotally connected to the transversely extending second connecting rod portion, the center portion being offset in the direction of the first axis thereby providing clearance for the crank link as the crank link rotates with the torque output member.

5. The internal combustion engine set forth in claim 1 wherein the adjusting means comprises a rotary cylindrical member rotatably supported on an adjustment axis by the housing, the pivot member being connected to the rotary cylindrical member at a location offset from the adjustment axis whereby the alignment member moves transversely relative to the first axis upon rotary adjustment of the rotary cylindrical member.

* * * * *